United States Patent [19]

Laib

[11] 4,089,415

[45] May 16, 1978

[54] AMPULE

[76] Inventor: Jakob C. Laib, Einfangstrasse 39, 8580 Amriswil, Switzerland

[21] Appl. No.: 705,081

[22] Filed: Jul. 14, 1976

[30] Foreign Application Priority Data

Aug. 15, 1975 Switzerland ..... 10684/75

[51] Int. Cl.[2] ..... B65D 3/26; B65D 17/24

[52] U.S. Cl. ..... 206/484.2; 206/524.2; 206/532; 206/524.3; 206/634

[58] Field of Search ..... 206/484, 532, 528, 498, 206/524.2

[56] References Cited

U.S. PATENT DOCUMENTS

| | | | |
|---|---|---|---|
| 2,760,630 | 8/1956 | Lakso | 206/532 |
| 3,039,246 | 6/1962 | David | 206/484 |
| 3,474,789 | 10/1969 | Soto | 206/484 |
| 3,567,463 | 3/1971 | Williams | 206/484 |

*Primary Examiner*—William T. Dixson, Jr.
*Assistant Examiner*—Douglas B. Farrow

[57] ABSTRACT

An ampule, a method of manufacturing the same and apparatus for the performance of such method is disclosed. The ampule comprises a hollow compartment for receiving medicaments or drugs which can be dispensed by means of a syringe. The wall bounding the hollow compartment is formed of a carrier layer composed of aluminum foil free of pores and having an inner layer formed of a heat sealable material which can be sterilized and does not react with the filled material. At the outside of the carrier layer there is provided a marked penetration or puncture location at which there can be pierced the wall by means of the needle of the syringe without damaging such needle.

14 Claims, 9 Drawing Figures

A

AMPULE

BACKGROUND OF THE INVENTION

The present invention relates to a new and improved ampule having a hollow compartment or space for the reception of drugs or medicaments which can be dispensed with the aid of a syringe, and this invention further pertains to a method for producing such ampules as well as apparatus for the performance of such method.

It is already known in this particular field of technology to fill pharmaceutical drugs into glass ampules, these drugs then can be dispensed by means of a syringe. In order to be able to withdraw the contents of the ampules it is first of all necessary to break the glass ampule. Additionally these glass ampules are associated with the drawback that they are prone to breakage and do not provide any protection against ultraviolet radiation. Additionally, the fabrication, filling, closing, marking and packaging of the glass ampules occurs in an extremely complicated manner. It is to be borne in mind in this context that the fabrication of the glass ampules does not occur at the same site where they are subsequently filled and closed, and hence, the ampules, after they are ready to be filled must be transported over considerable distance with considerable effort.

SUMMARY OF THE INVENTION

Hence, it is a primary object of the present invention to overcome the aforementioned drawbacks.

It is a further and more specific object of the invention to provide an ampule of the previously mentioned type which can be fabricated and filled in a simple manner, and in the filled condition permits storage without impairment of the filled contents and which furthermore possesses a sufficient mechanical strength and additionally nonetheless can be pierced with the needle of a syringe without thereby damaging such needle.

An additional object of the invention is to provide an ampule affording total unltraviolet protection and rendering possible the labeling and coding in a simple manner during the fabrication process.

Still a further object of the invention aims at the provision of an ampule of the aforementioned type as well as a method of manufacturing the same and apparatus for the performance of the method.

Now in order to implement these and still further objects of the invention, which will become more readily apparent as the description proceeds, the ampule of this development is characterized by the features that the wall bounding the hollow compartment consists of a carrier layer formed of pore-free aluminum foil which is provided with an inner layer formed of a sterilizable, heat sealable material which does not react with the filled contents. Moreover, at the outside of the carrier layer there is present a marked puncture location at which there can be pierced the wall by means of the needle of a syringe without damaging such needle.

The method for the fabrication of such ampule is characterized by the features that in a forming station for forming a first ampule portion in a section of a first material web which consists of at least a carrier layer of pore-free aluminum foil which is provided with an inner layer of a sterilizable, heat sealable material which does not react with the filled material of the ampule, there is formed a recess or depression surrounded by a marginal section. This first portion is connected by heat sealing at its marginal section, while leaving free a filling opening, with a section of a second material web, this section forming a second ampule portion, and which material web is similarly constructed as the first material web. After filling of the ampule the filling opening is closed by heat sealing.

As already alluded to above the invention is also concerned with apparatus for the performance of such method and is manifested by the features of a stationary punch having a cylindrical portion and two counter-punches situated oppositely with respect to the punch. The counter-punches are movable towards the punch into a closed position and away from the punch into an open position and each of them has a recess or depression into which engages, in the closed position, the cylindrical portion of the punch in order to form a recess in the material webs arranged between the punch and counter-punches.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE INVENTION

Figure 1:
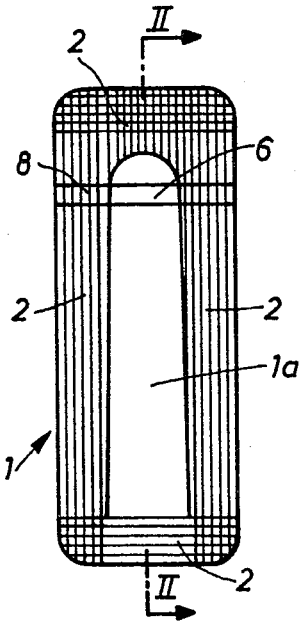
FIG. 1 is a front view of an ampule designed according to the invention.
Figure 2:
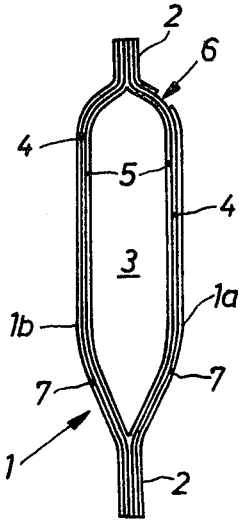
FIG. 2 is a sectional view along the line II—II of FIG. 1.
Figure 3:
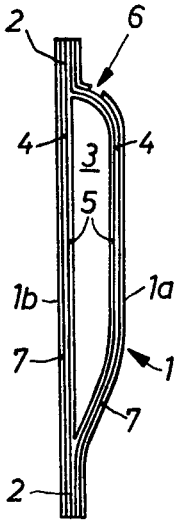
FIG. 3 is a sectional view, analogous to the showing of FIG. 2, of a further exemplary embodiment of an ampule.

Describing now the drawings, the ampule 1 illustrated in FIGS. 1 to 3 comprises two portions 1*a* and 1*b* which are connected with one another at the edge or margin 2 and enclose a hollow compartment or space 3 for the reception of drugs or medicaments which can be dispensed by means of a syringe.

Each of the portions or components 1*a* and 1*b* is formed from a section of a material web possessing a carrier layer 4 of a pore-free, soft or semi-hard aluminum which is provided with an inner layer 5 (varnish layer or film) of a sterilizable and heat-sealable material which does not react with the injection agent or ampule filling. This inner layer 5 can consist of a plastic foil, preferably a polypropylene film or high-pressure polyethylene film or of a layer of a sterilizable thermo-varnish.

At the outside of the aluminum carrier layer 4 there is provided a marked, varnish-free puncture location 6 at which there can be pierced the wall of the hollow compartment formed by the carrier layer 4 and the inner layer 5 by means of the needle of the syringe without damaging or contaminating such syringe needle.

With the illustrated exemplary embodiment wherein the carrier layer 4 is coated at the outside with a varnish layer 7 to which there can be applied inscription or writing, this puncture location 6 is marked by a varnish-free strip 8 (FIG. 1). The marking of the puncture location can however be accomplished in another random manner, for instance by providing a point-shaped recess in the varnish layer 7. In this regard it is to be observed that the puncture location is not covered by an outer layer in order to prevent contamination of the syringe needle by varnish particles.

The puncture location 6, if desired, can be held free from contamination by germs or bacteria, in other words sterile, by means of an adhesive strip which is applied to the sterilized ampule and must be removed prior to puncturing the ampule with the syringe needle.

The outer varnish layer 7 serves the purpose of enabling a direct imprinting of the ampule. It is therefore also conceivable that the aluminum carrier layer 4 is not covered with an outer varnish layer. In this case the necessary imprinting or inscription of the ampule must occur with the aid of a label adhesively applied to the ampule. This adhesive label then could be simultaneously employed for protecting the puncture location as mentioned above.

Instead of the varnish layer 7 the carrier layer 4 can also exhibit at the outside a laminated-on plastic film which has already been imprinted or can later be imprinted. This plastic film can cover the puncture location 6, and in this case the plastic film together with the aluminum carrier layer 4 must be capable of being pierced without damaging the syringe needle.

In order that the aluminum carrier layer 4 is gas-tight and water-tight and allows for a total protection of the filled material against ultraviolet radiation it must be free of pores. In order to satisfy this requirement, with the present state of the technology available in this art the aluminum carrier layer 4 must possess a minimum thickness of about 0.040 mm. In order to enable puncturing the ampule wall by means of the syringe needle, the carrier layer 4 must however must not be too thick so that as a practical matter the upper limit is a thickness in the order of about 0.080 mm.

In order to enable deep freezing and lyophilization the material of the inner layer 5 must be formed such that it is not damaged in the presence of the low temperatures which arise. With the ampule of FIG. 2 the hollow compartment or space 3 is formed by a respective recess or depression formed in each portion or component 1*a* and 1*b*. Both of the portions 1*a* and 1*b* are the same in shape and size. With the embodiment of FIG. 3 the hollow compartment 3 is only formed by a recess formed in the portion 1*a*, whereas the portion 1*b* is not formed and is constructed as a flat material web. The portions 1*a* of FIGS. 2 and 3 are the same, so that the ampule of the showing of FIG. 3 has a volumetric capacity which is about half that of the ampule of FIG. 2. The components 1*a* and 1*b* could however possess dissimilar form and size.

Figure 4:
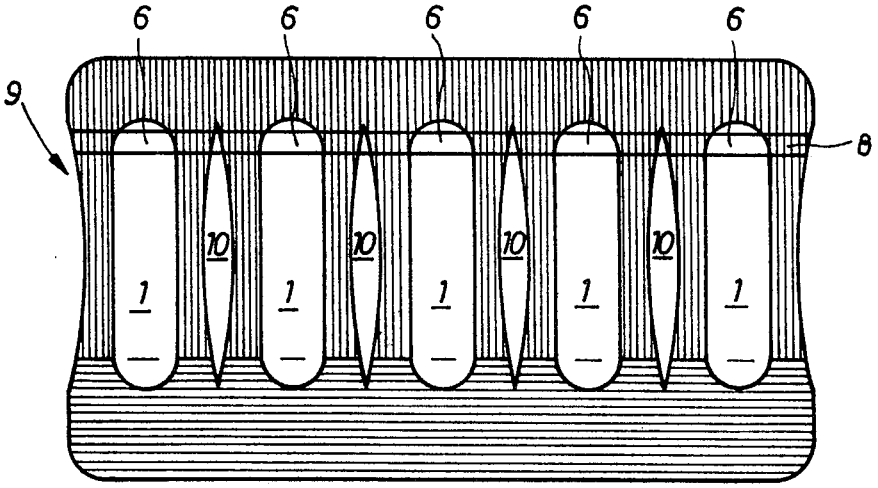
FIG. 4 is a front view of a multiple package consisting of a number of adjacently suspended ampules.

In FIG. 4 there is illustrated a multiple package 9 formed of a number of adjacently suspended or arranged ampules 1. The ampules 1 can be constructed either according to FIG. 2 or FIG. 3. Each ampule 1 possesses a marked puncture location 6 which, for instance, is formed by a varnish-free strip 8 extending over the entire width of the package or pack 9. Between neighboring ampules 1 there are provided substantially slit-shaped openings 10 along which it is possible to detach the individual ampules 1. It is also possible to provide between the individual ampules perforation or tear-lines which guarantees for an easy tearing away of the individual ampules.

The previously described ampule protects the injection agent or contents against gas and water vapor as well as against ultraviolet radiation. After the ampule has been filled it can be sterilized in an autoclave or it can be rendered free of germs and bacteria, i.e., sterilized by irradiation before or after the forming or shaping operation. It likewise permits the deep-freezing and lyophilization of the filled material. The wall of the ampule can be pierced by a syringe needle without damaging the same, but possesses sufficient mechanical strength in order to withstand the loads acting upon the ampule. The ampule can possess any random shape, but the shape of the ampule should be chosen such that a syringe needle can penetrate easily through the ampule wall and without sliding away from the puncture or penetration location. Additionally, there should be insured for the practically complete removal of the contents or filling of the ampule.

By appropriately shaping or configuring the ampule there can be avoided that when the syringe needle is introduced into the hollow compartment it will penetrate the ampule wall from the inside towards the outside. The described ampule can be fabricated in optional manner as individual- or multiple packages. It can, as described, consist of two portions or parts or also of one part. Preferably the ampule is formed of one or two material webs, subsequently filled and closed.

Based upon the schematic illustrations of FIGS 5 to 9 there will now be described a preferred fabrication technique for the filled ampules.

Figures 5, 6:
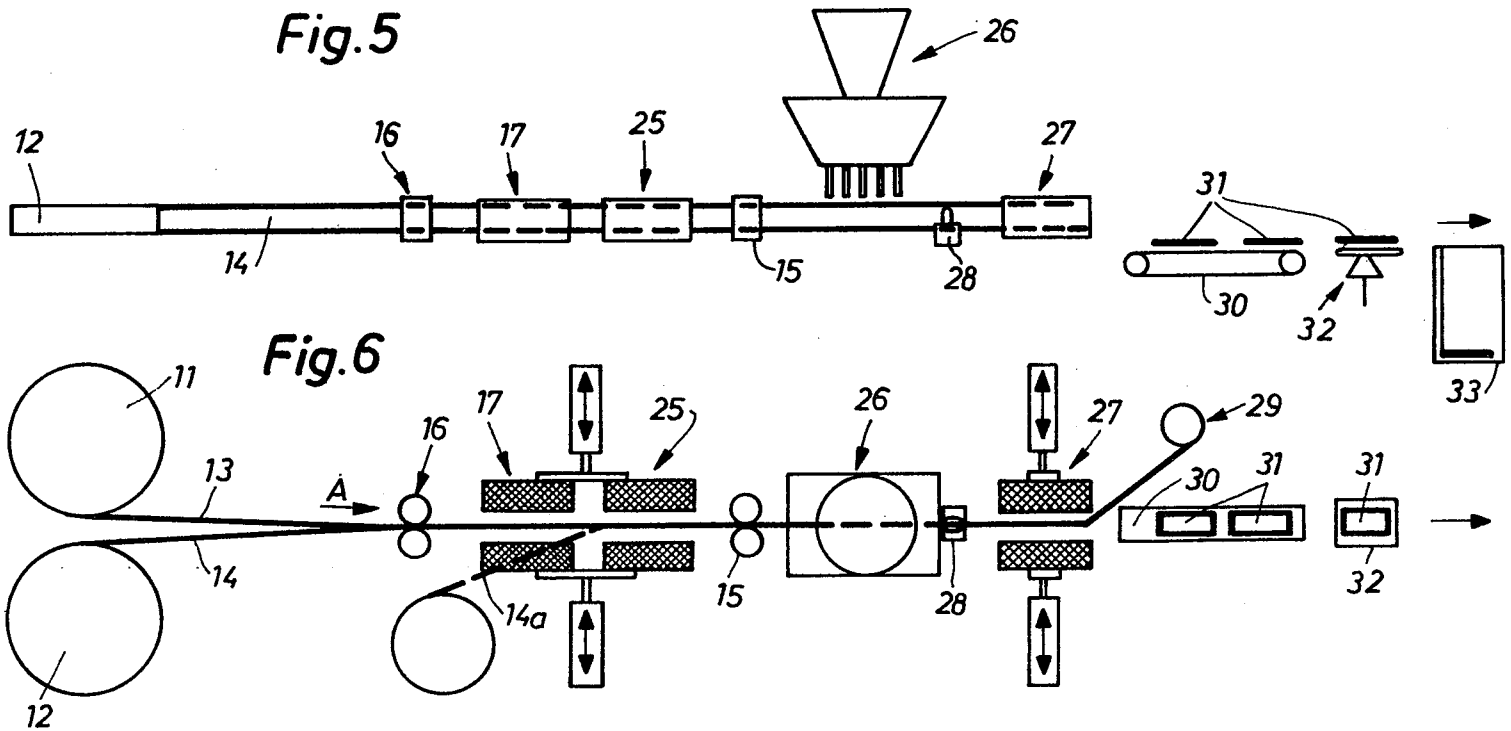
FIG. 5 is a schematic side view of an installation or apparatus for fabricating and filling ampules.
FIG. 6 is a schematic top plan view of the apparatus of FIG. 5.

FIGS. 5 and 6 schematically illustrate in side view and top plan view, respectively, an apparatus or installation for manufacturing a filled ampule.

By means of a traction device 15 a respective material web 13, 14 is withdrawn from two brake-regulated rolls 11, 12. Each material web as already discussed in conjunction with FIGS. 1 to 3 consists of a carrier layer formed of aluminum which is provided at the inside with the inner layer and at the outside with the outer layer. Under certain circumstances, as already previously explained, the outer layer can be dispensed with.

The material webs 13, 14 must be arranged such that the inner layers are oppositely situated. The material webs 13, 14 can be pre-printed or left unprinted. In the last mentioned case the imprinting can occur at a printing station prior to the forming or shaping operation.

In the case of imprinted material webs the control of the advance or forward feed can occur by means of photoelectric cells. In the case of unprinted material webs there is undertaken a mechanically controlled forward feed. Depending upon the size of the recess to be formed in the material web and dependent upon the strength of the material webs, and prior to the actual shaping or forming operation of the material webs 13, 14, slots extending at right angles to the feed direction A of the webs 13, 14 are provided with the aid of a punch device 16 in order to permit a post-flow of the material during the subsequent forming or shaping operation. These slots are shown in FIG. 4 and designated by reference character 10. With small recesses or depressions and/or thick material it is possible to dispense with this punching operation.

Figure 9:
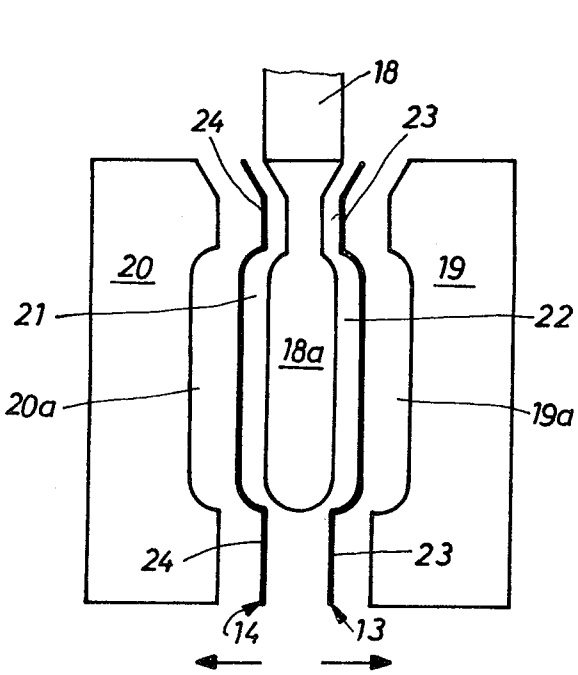
FIGS. 7, 8 and 9 are schematic views of the tool during different phases of operation for forming a hollow compartment or space in the ampule.
Figure 8:
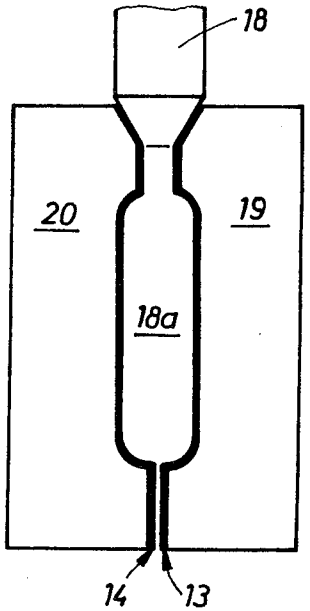
Figure 7:
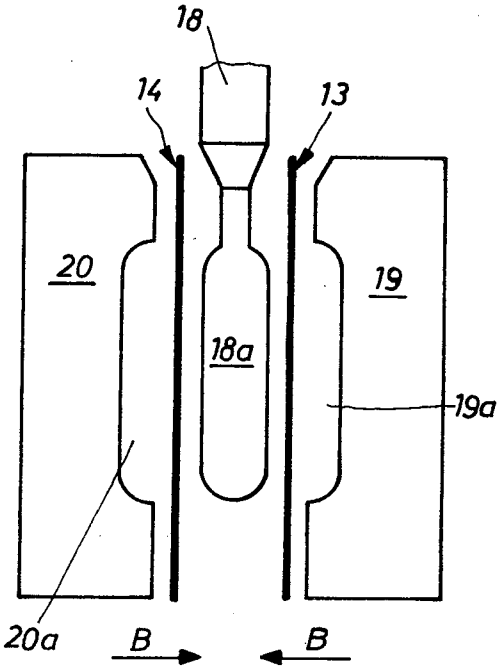

Thereafter the vertically positioned material webs 13, 14 pass through the forming or shaping station 17. Based upon the showing of FIGS. 7 to 9 there will be explained the forming or shaping of both ampule halves 1a, 1b (FIG. 2). Both of the material webs 13, 14 travel into a press between a stationary punch 18 and a respective counter-punch 19 and 20. Each of the counter-punches 19 and 20 possesses a recess or depression 19a and 20a respectively into which engages the cylindrical portion or part 18a of the punch 18 with the tool closed. In FIG. 7 the tool is shown in the open condition. From this open condition the counter punches 19, 20 are moved towards one another in the direction of the arrows B, and the material webs 13, 14 are shaped or formed between the punch 18 and the counter-punches 19, 20. FIG. 8 illustrates the tool in the closed condition. The material webs 13, 14 have been shaped in accordance with the shape of the punch 18 and the counter-punches 19, 20. FIG. 9 illustrates the tool which has been again opened after completion of the forming or shaping operation. The material webs 13, 14 each possess a recess 21, 22 which are completely surrounded by a marginal or edge section 23 and 24 respectively, wherein in the showing of FIG. 9 there has only been shown the upper and lower part. The recesses 21, 22 collectively form the hollow compartment or space 3 of the ampule 1 (FIGS. 1 to 3).

The ampules halves formed simultaneously in the described manner now are advanced to a sealing station 25 (FIGS. 5 and 6) where both ampule halves are connected with one another by heat sealing their marginal or edge sections 23 and 24 up to the filling opening.

Previously there was described as a matter of simplicity the fabrication of one ampule. To increase the work speed of the entire installation there are however simultaneously fabricated in the described manner a multiplicity of ampules, for instance five ampules with the aid of multiple tools.

The thus formed ampules which are open at the top and suspended at one another are delivered in groups to a filling station 26 and filled with a dosed quantity of the injection agent or filling material and by means of a feed device 28 delivered to a sealing- and punch station 27. In this sealing-and punch station 27 there are closed by heat sealing the infeed openings, the ampules are coded and depending upon whether one is dealing with individual- or multiple packages the individual ampules are separated from one another or between neighboring ampules there are provided separation perforations (multiple packages).

The modern day automatic filling machines can fill approximately 10,000 to 12,000 ampules per hour. The resultant clock time of approximately 1.4 seconds for each package of 3 ampules is sufficient to carry-out the shaping, sealing, end closure and feed operations.

The punch or stamping waste which is formed is rolled-up by means of a roll-up device 29. A conveyor band 30 transports the closed ampules 31 via a weight control balance 32 to a container 33 where the ampules are brought for subsequent sterilization to autoclaves, should this operation be necessary.

Previously there was described the manufacture of ampules according to FIG. 2 which consist of two similiarly shaped halves 1a, 1b.

However, without changing the tool 18, 19, 20 in the shaping or forming station 17 it is possible to form ampules of the type shown in FIG. 3 wherein only one part 1a has a recess or depression. For this purpose there is only delivered through the forming or shaping station 17 the one material web 13 and which, as already described in conjunction with FIGS. 7 to 9, is provided with one recess 22. After the shaping station 17 and prior to the sealing station 25 there is introduced a second material web 14a (shown in broken lines in FIG. 6) which as far as the material is concerned corresponds to the web 13. In the sealing station 25 the shaped material web 13 is then heat sealed at the edge sections 23, with the exception of the infeed opening, with the flat, non-deformed material web 14a. The further process operations then occur from this point in time in the already described manner.

The described apparatus thus renders possible, without the need to change tools, by infeeding the second material web, to fabricate before or after the shaping station 17 ampules of the type shown in FIGS. 2 or 3 respectively with different volumes. Thus, there can be produced, practically without any resetting up of the installation, ampules which are used most frequently in the pharmaceutical industry having a capacity or volumetric content of 2 cl or 1 cl in the aforedescribed manner.

While there is shown and described present preferred embodiments of the invention, it is to be distinctly understood that the invention is not limited thereto, but may be otherwise variously embodied and practiced within the scope of the following claims. Accordingly,

What is claimed is:

1. An ampule comprising a wall enclosing a hollow compartment for receiving drugs which can be dispensed with the aid of a syringe having a syringe needle, the wall bounding the hollow compartment comprising a carrier layer formed of pore-free aluminum foil capable of being punctured by a syringe needle without damaging the needle and having an inner layer with a sterilizable heat-sealable material which does not react with the contents of the ampule, an exposed, marked puncture location being provided at the outside of the carrier layer and at which location the wall can be pierced by means of the needle of the syringe without damaging such needle.

2. The ampule as defined in claim 1, wherein the inner layer comprises a plastic foil which can be sterlized and connected with the carrier layer.

3. The ampule as defined in claim 2, wherein the plastic foil is a polypropylene foil.

4. The ampule as defined in claim 2, wherein the plastic foil is a high-pressure polyethylene foil.

5. The ampule as defined in claim 1, wherein the inner layer consists of a sterlizable thermal-varnish.

6. The ampule as defined in claim 1, further including a removable protective strip for covering the puncture location.

7. The ampule as defined in claim 1, wherein the wall consists of two portions, at least one of which portions is provided with a recess.

8. The ampule as defined in claim 7, wherein the wall comprises two portions, each of which possess a recess forming the hollow compartment, and wherein the edges surrounding such recesses are connected with one another by heating sealing.

9. The ampule as defined in claim 7, wherein the second portion comprises a non-deformed material section which is connected by heat sealing with the edge surrounding the recess of the first portion.

10. An ampule comprising a wall enclosing a hollow compartment for receiving drugs which can be dispensed with the aid of a syringe having a syringe needle, the wall bounding the hollow compartment comprising a carrier layer formed of pore-free aluminum foil capable of being punctured by a syringe needle without damaging the needle and having an inner layer with a sterilizable heat-sealable material which does not react with the contents of the ampule and an outer layer, a marked puncture location being provided at the outside of the carrier layer and at which location the wall can be pierced by means of the needle of the syringe without damaging such needle.

11. The ampule as defined in claim 10, wherein the plastic film covers the puncture location and can be pierced at this puncture location together with the carrier layer.

12. An ampule comprising a wall enclosing a hollow compartment for receiving drugs which can be dispensed with the aid of a syringe having a syringe needle, the wall bounding the hollow compartment comprising a carrier layer formed of pore-free aluminum foil capable of being punctured by a syringe needle without damaging the needle and having an inner layer with a sterilizable heat-sealable material which does not react with the contents of the ampule and an outer layer, a marked puncture location being provided at the outside of the carrier layer and said outer layer having an opening exposing said puncture location in order to prevent contamination of the syringe needle by particles of the outer layer and at which location said foul and said inner layer can be pierced by means of the needle of the syringe without damaging such needle.

13. An ampule as claimed in claim 12 wherein said outer layer is imprintable.

14. An ampule as claimed in claim 13 further including a removable protective strip over said outer layer and said opening therein exposing said puncture location.

* * * * *